US007854668B2

(12) United States Patent
Shelton

(10) Patent No.: US 7,854,668 B2
(45) Date of Patent: Dec. 21, 2010

(54) LASER BALL SHOOTING AID

(76) Inventor: Lance Shelton, 3450 Sawtelle Blvd. #306, Los Angeles, CA (US) 90066

( * ) Notice: Subject to any disclaimer, the term of this patent is extended or adjusted under 35 U.S.C. 154(b) by 163 days.

(21) Appl. No.: 12/107,757

(22) Filed: Apr. 22, 2008

(65) Prior Publication Data

US 2009/0042674 A1 Feb. 12, 2009

Related U.S. Application Data

(60) Provisional application No. 60/964,118, filed on Aug. 10, 2007.

(51) Int. Cl.
*A63B 69/00* (2006.01)

(52) U.S. Cl. ..... 473/450; 473/422; 473/447

(58) Field of Classification Search ..... 473/422, 473/450, 458, 464, 433, 472, 479, 480, 212, 473/220; 434/248
See application file for complete search history.

(56) References Cited

U.S. PATENT DOCUMENTS 3,707,291 A * 12/1972 Tredway ..... 473/202
3,762,719 A * 10/1973 Smith ..... 473/212
3,811,684 A * 5/1974 Tredway, Sr. ..... 473/212
4,592,545 A * 6/1986 Sagedahl et al. ..... 482/7
4,805,905 A * 2/1989 Haub ..... 473/450
4,913,441 A * 4/1990 Freer ..... 473/220
5,067,717 A * 11/1991 Harlan et al. ..... 473/209
5,135,217 A * 8/1992 Swain ..... 473/450
5,149,085 A * 9/1992 Sanchez ..... 473/450
5,236,190 A * 8/1993 Moss ..... 473/450
5,354,050 A * 10/1994 McCarthy ..... 473/458
5,544,877 A * 8/1996 Brownell ..... 473/450
5,865,695 A * 2/1999 Mahala et al. ..... 473/450
6,148,280 A * 11/2000 Kramer ..... 702/153
6,659,618 B2 * 12/2003 Waters ..... 362/106
6,712,722 B1 * 3/2004 Mosley ..... 473/450
6,800,035 B1 * 10/2004 Couch ..... 473/213
6,902,493 B1 * 6/2005 Rhodes et al. ..... 473/268
2006/0057549 A1 * 3/2006 Prinzel et al. ..... 434/247
2007/0066415 A1 * 3/2007 Hou et al. ..... 473/219
2007/0219025 A1 * 9/2007 Aberton et al. ..... 473/450
2009/0042674 A1 * 2/2009 Shelton ..... 473/450
2009/0298621 A1 * 12/2009 Moye ..... 473/450

* cited by examiner

*Primary Examiner*—Mitra Aryanpour
(74) *Attorney, Agent, or Firm*—James A. Italia; Italia IP

(57) ABSTRACT

A signal projecting device wearable on an athlete about to throw a projectile, such as shooting a basketball. The device incorporates a leveling sensor arranged to provide an input signal to the projecting device so that a signal indicative of a body part on which the projecting device is mounted being horizontal with respect to a floor or ground surface. The projecting device may project a generally cruciform light beam of one characteristic, such as color or light pattern, when the horizontal condition is sensed. A second light beam of a different characteristic may be projected when the horizontal condition is not sensed.

9 Claims, 5 Drawing Sheets

LASER BALL SHOOTING AID

CROSS-REFERENCE TO RELATED APPLICATION

This application claims the benefit of the filing date under 35 USC 119(e) of the filing date of U.S. Provisional Application Ser. No. 60/964,118, filed Aug. 10, 2007.

FIELD OF THE INVENTION

The present invention relates to a body worn device for indicating to a person orientation of his or her arm relative to the horizontal and vertical, and a method of using such device. The device and method serve as training aids in shooting a basketball.

BACKGROUND OF THE INVENTION

Many devices and methods have been proposed for improving athletic performance in well established sports such as baseball, football, and basketball, among others. In these sports, where accuracy in throwing a ball is concerned, it is frequently the conclusion of coaches that for each sport, there is an idealized motion for throwing that is most likely to result in maximal throwing accuracy. It follows that training aids have been developed for encouraging promulgated idealized motions, as well as for other aspects of the games.

In the sport of basketball, several considerations influence shot accuracy. In correct shooting form, a player's forearm should be perpendicular to the basketball court floor and/or the player's upper arm should be parallel to the basketball court floor. The rest of the shooter's body should assume a certain orientation relative to the basket apart from arm orientation. Further, a desired follow-through motion is regarded as important.

SUMMARY OF THE INVENTION

The present invention sets forth apparatus and method for providing visual cues for a basketball player that body position and orientation are appropriate, so that shooting accuracy may be improved.

The apparatus comprises a body worn laser projector which projects a visible image onto an environmental surface or surfaces to serve as a cue to the basketball player as to body position relative to the basket. The projector may project two mutually perpendicular thin beams of light, such as laser light, hereinafter referred to as lines, or may project light in other patterns. The lines may include a first line intended to be horizontal and an intersecting second line intended to be vertical. The two laser lines complementarily generate an image akin to the crosshairs of a rifle sighting scope, for example. Alternatively, the image may be as uncomplicated as a point or a small and compact configuration such as a circle. Other patterns such as stars may also be projected.

The horizontal and/or vertical line establishes the shooter's shooting arm relative to its environment and body position. The player is to shoot the ball when the two lines are parallel or perpendicular to landmarks in the environment, such as a basketball backboard. In addition, the vertical line should be at or near the rim of the basket.

The method of use includes a step of undertaking basketball shooting motions when the horizontal and vertical lines are horizontal and vertical relative to the basketball court and basket, and the vertical line is at or near the center of the basket.

The step of shooting at the time of the indicated conditions promotes a learning experience based on muscle memory, wherein the player is encouraged to assume correct shooting form, with the shooting arm being perpendicular to the ground or basketball court floor, with correct arm and body alignment, with the shooting arm in proper shooting position, and to encourage correct follow through after the shot.

The apparatus combines a laser projection system with a leveling system. One signal is projected when the apparatus is level, and another signal is projected when the apparatus is not level.

Level orientation on the court is signaled visually through a characteristic of the laser line, such as for example by color of the projected line, such as green, or as another example, by the laser being on continuously. In these two examples, out of level orientation is signaled respectively by the projected lines being rendered in another color, such as red, or by interruption of the projected light, such as blinking.

It is an object of the invention to provide basketball shot training which causes a basketball player to be able to assess his or her bodily orientation relative to a basketball court and basket at the time of making a shot.

It is another object to condition a basketball player to orient his or her body in correct arm and body alignment and to maintain the shooting arm in proper shooting position, and to encourage correct follow through after a shot.

It is a further object of the invention to project onto environmental surfaces visible images comprising visible elements forming perpendicular intersecting lines.

It is still another object of the invention to provide visual cues indicating to a basketball player his or her bodily orientation relative to a basketball court.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
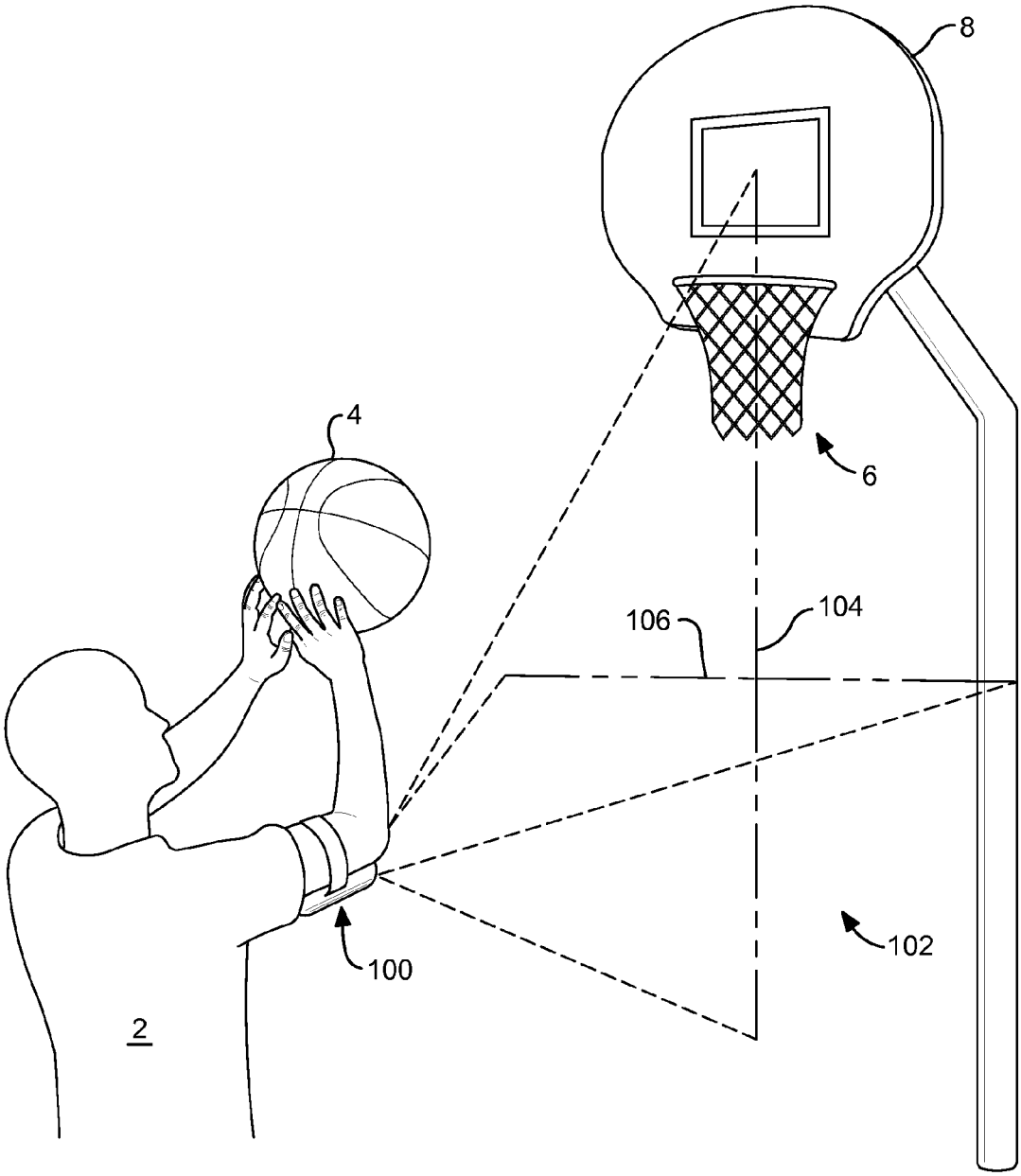
FIG. 1 is a diagrammatic perspective view of a basketball player on a basketball court, about to shoot a basketball and using an apparatus according to at least one aspect of the invention.

FIG. 1 of the drawings shows a basketball player 2 on a basketball court (not shown in its entirety), about to shoot a basketball 4 towards a basket 6, and using an apparatus 100 according to at least one aspect of the invention. The apparatus 100 performs the function of indicating bodily orientation of a basketball player such as the basketball player 2 relative to a basketball facility including a floor surface, a basket such as the basket 6, and typically but not necessarily a backboard 8. It will be appreciated that basketball facilities may be indoor, such as those conventionally called courts, or outdoors. Therefore, reference to a floor surface will be understood to encompass outdoor surfaces such as for example tarmac playground surfaces.

The apparatus 100 is strapped to or otherwise engages the body of the basketball player 2, and projects onto the environment a thin beam of light which is visible to human perception. The thin beam of light may be laser or otherwise, and may be visible when impinging upon an environmental surface, or may be arranged to form an image 102 which is visible to the front of the basketball player 2 but which does not rely upon impinging solid objects, such as being of the nature of so-called heads up displays.

As shown in FIG. 1, the image 102 is generally cruciform in configuration, thereby extending in two orthogonal directions. Orthogonal directions include a vertical component 104 and a horizontal component 106. Of course, orientation of the vertical component 104 and of the horizontal component 106 is depended upon body position of the basketball player 2, and therefore will frequently change in the course of play of a game or during shooting practice as the basketball player 2 moves. The purpose of the image 102 is to indicate to the basketball player 2 when he or she is in a body orientation relative to the basket 6 and the backboard 8 to shoot accurately. This is predicated upon a predetermined shooting protocol established to inculcate habits and bodily positioning deemed favorable to the mechanics of shooting the basketball 4, as these mechanics pertain to shooting accuracy. Body positioning encompasses a predetermined orientation relative to a vertical direction and a predetermined alignment of arm position to the body. The protocol encompasses body positioning, shooting motions, and follow through, the latter concept relating to continuing the shooting motion and subsequent actions after the basketball 4 has been released during the shot.

One of the important aspects of the protocol is that the upper arm be as oriented as closely as is feasible to a horizontal direction, or that the forearm be oriented as closely as is feasible to a vertical direction, or both. The apparatus 100 enables the basketball player 2 to discern these relationships without undue disruption of the act of shooting the basketball 4.

Orientation of the body may be judged by considering the image 102. The image 102 has changeable characteristics depending upon whether the horizontal component 102 and the vertical component 104 are actually respectively horizontal and vertical. It should be understood that the terms horizontal component 102 and vertical component 104 are so called more to distinguish between the two for the purposes of explanation, rather than literally signifying actual horizontal and vertical orientation. The apparatus 100 operates selectively in a first operating mode wherein the thin beam of light or image 102 displays a first optical characteristic, and at other times changing to a second operating mode wherein the thin beam of light or image 102 displays a second optical characteristic.

According to one aspect of the invention, the image 102 may be rendered in one color, such as green when the horizontal component 106 is truly horizontal, and may be rendered in another color such as red when the arm of the basketball player 2 is out of horizontal relationship to the floor. In the example just described, the first operating mode may be that indicating the horizontal condition, and the second mode may be that indicating the condition wherein the arm is out of horizontal relationship to the floor.

If color is relied upon to signal whether the body orientation or orientations are appropriate for shooting, then it is not necessary to rely upon alignment of projected lines to shoot or refrain from shooting. Any projected pattern may be employed to convey the two modes. For example, a single solid or broken line (not shown), which may be either horizontal or vertical, may be projected.

If desired, the operating modes may also consider vertical orientation of the arm. It is possible that the upper arm be horizontal while the forearm be out of a vertical orientation. If both horizontal and vertical conditions are to be considered, then the first operating mode prevails only if both horizontal and vertical orientation are satisfied, and the second operating mode will prevail at all other times.

The optical characteristic displayed by each of the operating modes may be other than the color or hue of the displayed image. For example, the image 102 may be formed intermittently or be interrupted when horizontal and vertical conditions are not satisfied. As an example, the image 102 may be caused to flash on and off, or blink. The image 102 may be formed by uninterrupted projection when the horizontal and vertical conditions are satisfied. Uninterrupted or constant projection, as opposed to interrupted projection, are therefore another optical characteristic which may be varied to distinguish between operating modes.

More than one optical characteristic may be selected for any one operating mode. For example, the horizontal and vertical condition may be signaled by green color and constant, uninterrupted projection of the image 102, whereas failure to achieve the horizontal and vertical condition may be signaled by changing to another color and flashing projection. Any operating mode may be provided with any selected optical characteristic or combination thereof. The number and nature of optical characteristics will be referred to as a scheme of projection. Hence, there is at least one scheme of projection, and where horizontal and/or vertical conditions are indicated separately and differently from non-horizontal and/or non-vertical conditions, there is at least a second scheme of projection. It would be possible to add other schemes of projection to indicate still other conditions.

Figure 2:
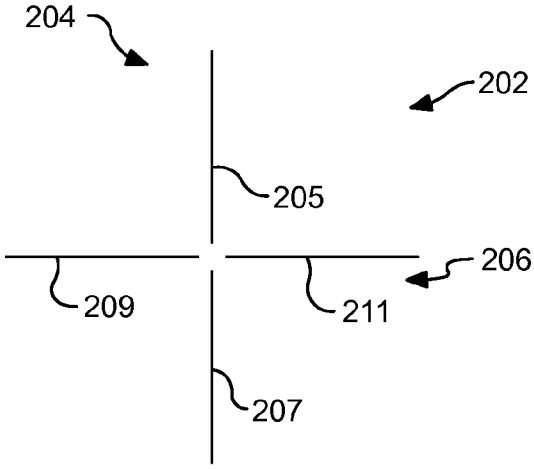
FIG. 2 is a diagrammatic depiction of a generally cruciform visible image which may be projected by an apparatus according to at least one aspect of the invention.
Figure 3:
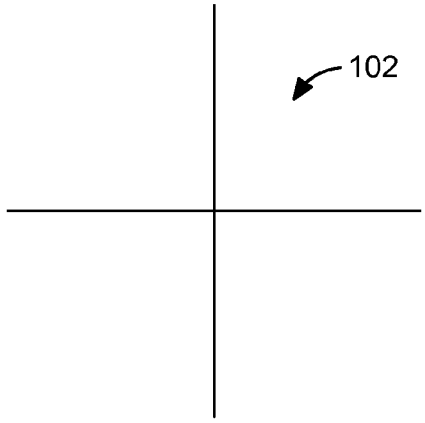
FIG. 3 is similar to FIG. 2, but shows a different image.

The image 102 has been described as being generally cruciform in nature. This does not necessarily imply that the image 102 be a fully formed cruciform. As seen in FIG. 2, an image 202, which is a functional counterpart to the image 102 (FIG. 3), may have a vertical component 204 formed in two spaced apart segments 205 and 207. Similarly a horizontal component 206 may comprise two spaced apart segments 209 and 211.

Figure 4:
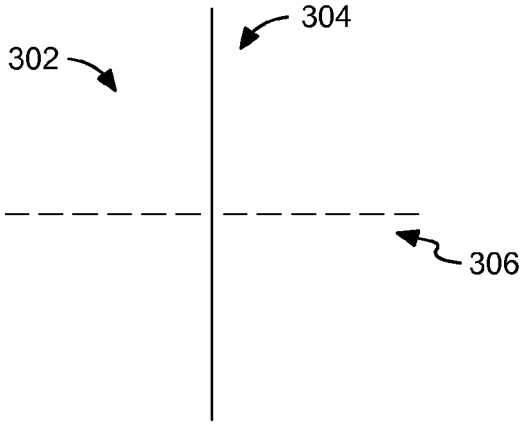
FIG. 4 is similar to FIG. 2, but shows a further different image.

As illustrated in FIG. 4, an image such as the image 302 need not have similarly configured components. The image 302 may have a vertical component 304 formed as a solid line, and a horizontal component 306 formed as a succession of spaced apart segments.

Figure 5:
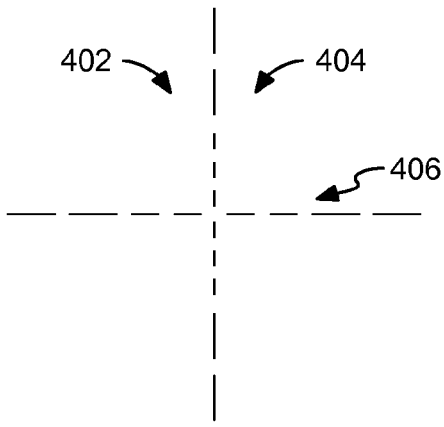
FIG. 5 is similar to FIG. 2, but shows a still further different image.

Referring now to FIG. 5, an image 402 may comprise a vertical component 404 formed in segments of unequal length and a horizontal component 406 also formed in segments of unequal length.

The various possible characteristics of the components of the various images, such as the images 202, 302, and 402 may be configured and selected in any desired combination and additionally may include visual or graphic aspects other than those illustrated and described. Regardless of its specific nature, any projected image such as the images 202,302, and 402 provide an overall visual impression of a cruciform sufficiently to enable a person such as the basketball player 2 to orient himself or herself appropriately on a basketball court using visual cues acquired from the projected image.

Also, the image and its component segments will comprise components and segments thereof which are discernible as thin lines to an extent enabling ready recognition of the direction being indicated by the image.

Figure 6:
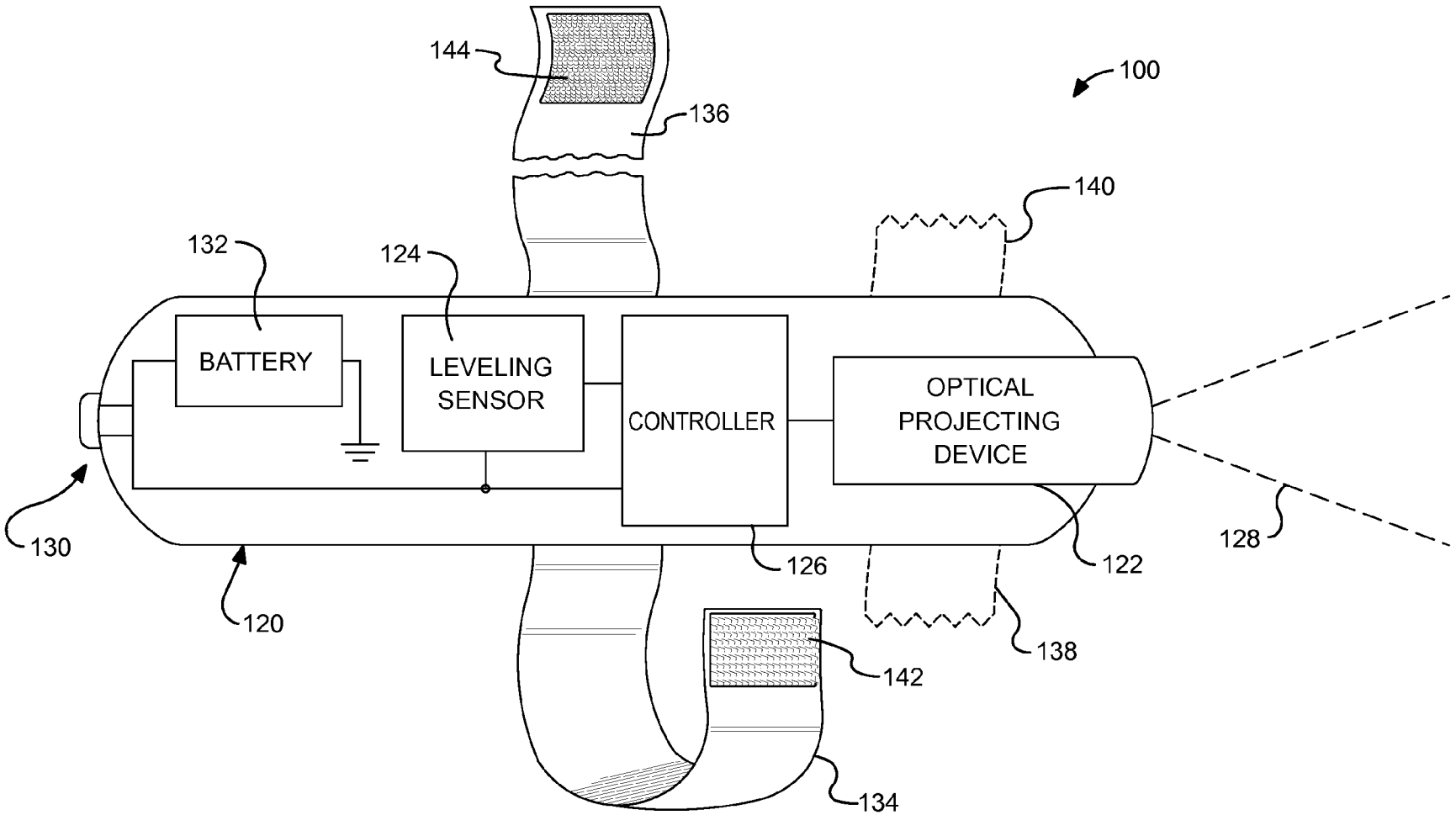
FIG. 6 is a diagrammatic view of an apparatus which may project an image according to at least one aspect of the invention, and of components of the apparatus.

Turning now to FIG. 6, the apparatus 100 may comprise a housing 120 of dimensions and configuration which are conveniently attached to the arm and are not unduly distracting to a user such as the basketball player 2. The apparatus 100 may also comprise an optical projecting device 122 which is capable of projecting a beam of light onto the environment of the basketball facility so as to form a generally cruciform image such as any of the images 102, 202, 302, and 402. A leveling sensor 124 may be provided to establish a horizontal condition of direction of projection of a component of the image, such as any of the images 102, 202, 302, and 402. The leveling sensor 124 may be arranged to establish a condition other than the horizontal. The leveling sensor 124 may be arranged to further establish a vertical condition of direction of protection of another component of the image. Alternatively, a separate second sensor (not shown) may provide an input pertaining to vertical orientation.

A controller 126 may be provided to control characteristics of a projected image selectively in the first operating mode and in the second operating mode, responsive to inputs from sensors such as the leveling sensor 124. The optical projecting device 122 will then project an image (projection is indicted representatively in broken lines such as the line 128) selectively according to the first operating mode and the second operating mode.

The apparatus 100 may further comprise an on-off switch 130 and associated circuitry disposed to effect and discontinue operation of the optical projecting device 122. Power may be obtained from an electrical cell, battery, capacitor of any known type, or any combination of these. Regardless of its specific nature, the power source is referred to as a battery 132.

Circuitry is not specifically called out by reference numerals, but is shown representatively in lines connecting the optical projecting device 122, the leveling sensor 124, the controller 126, the battery 132, and the switch 130. Circuitry will be understood to comprise the number of conductors and connection scheme necessary to carry out the described functions.

The apparatus 100 further comprises a body attachment element disposed to releasably attach the apparatus to the body of a person such as the basketball player 2. The body attachment element may comprise a first flexible strap 134 and a second flexible strap 136. It would be possible to provide additional flexible straps such as the straps 138 and 140. Each of the straps includes a fastener such as complementary patches of hook and loop fastener 142, 144.

Regardless of their number and nature, the straps such as the straps 134, 136 enable adjustment of the apparatus 100, or alternatively, of the optical projecting device 122 to align with the body of an athlete such as the basketball player 2 in a position assuring operable signals or projected images such as the images 102, 202, 302, 402. Operable signals are those which cause the projected image to accurately signal the horizontal condition, the vertical condition, or both.

Figure 7:
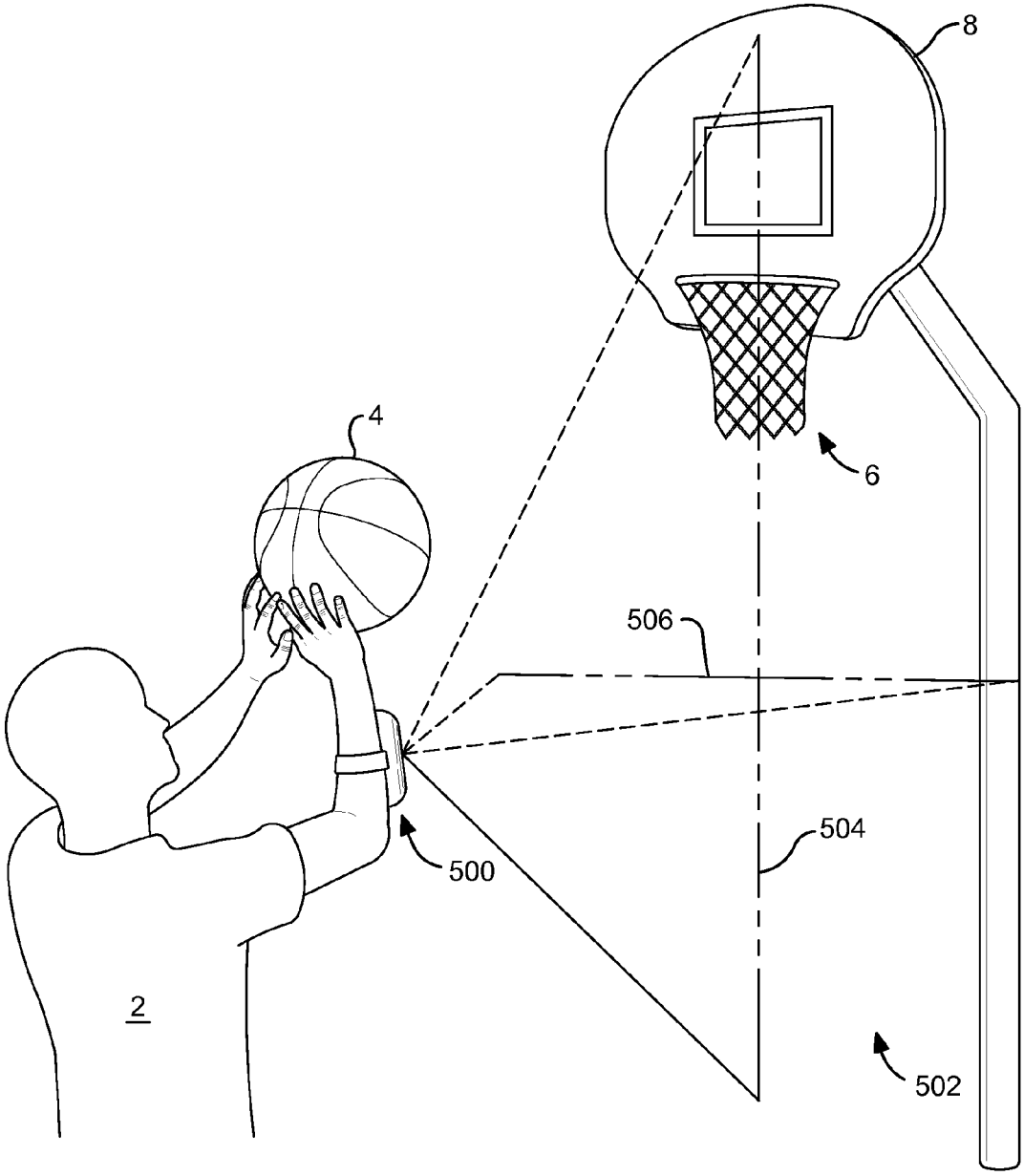
FIG. 7 is a diagrammatic perspective view of a basketball player on a basketball court, about to shoot a basketball and using an apparatus according to a further aspect of the invention.

Referring now to FIG. 7, an apparatus 500 is shown attached to the forearm of the basketball player 2. The apparatus 500 is generally the functional and structural equivalent of the apparatus 100 of FIG. 1, but is adapted for mounting on the forearm. To this end, the apparatus 500 may have an optical projecting device (not shown) which is similar to the optical projecting device 122 (FIG. 6) which is located on a side of the apparatus 500 which would enable projection of an image 502 from the forearm. The image 502 may indicate a horizontal condition or a vertical condition or both, and if desired, failure to achieve the horizontal condition or the vertical condition or both, in the same way as is performed by the apparatus. The image 502 may comprise a vertical component 504 and a horizontal component 506 in a manner generally similar to that of the image 102. The apparatus 500 may have the same functional components as those described for the apparatus 100, but reconfigured and rearranged to suit projection of the image 502.

Figure 8:
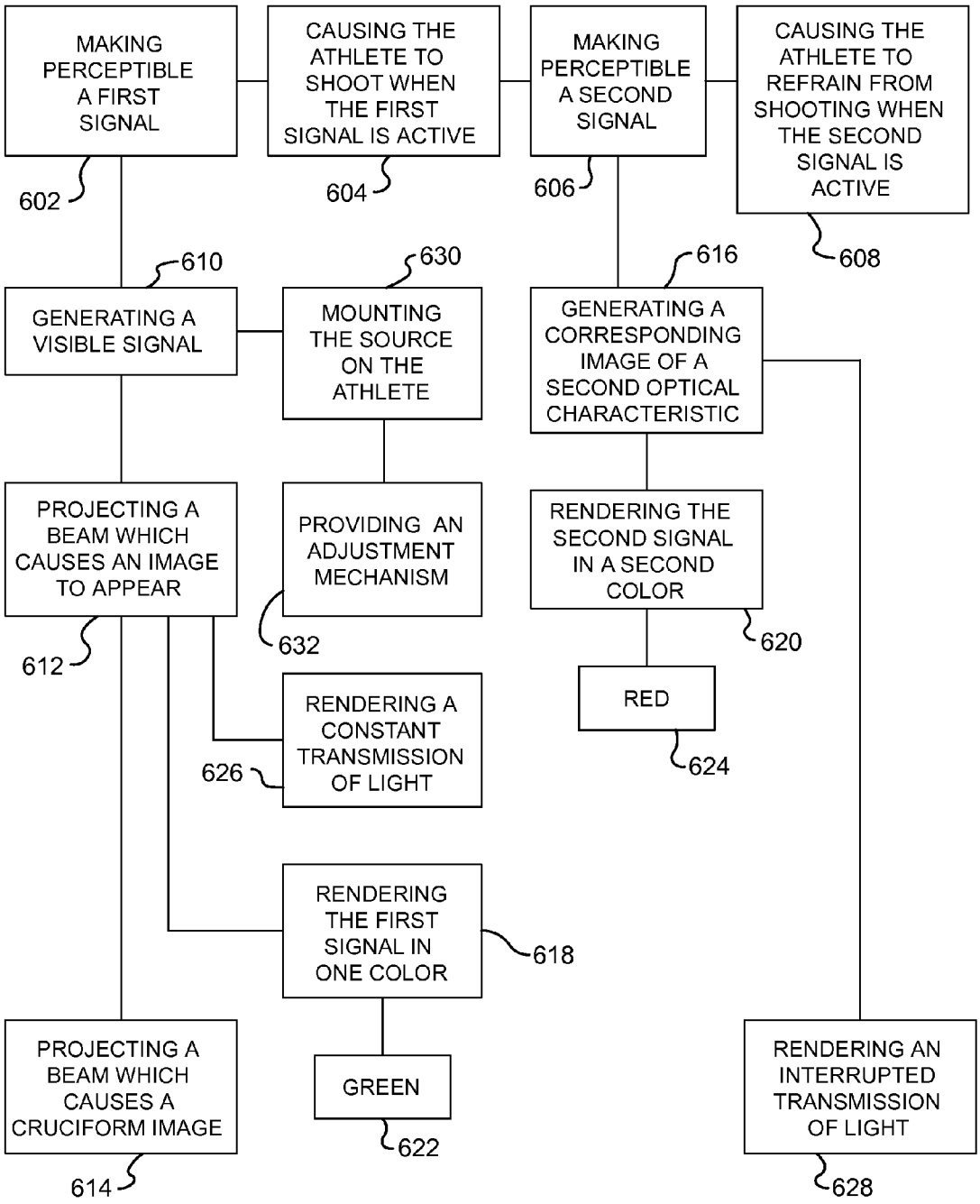
FIG. 8 is a block diagram showing steps of at least one method of practicing the invention.

As shown in FIG. 8, according to another aspect, the invention contemplates a method 600 of training an athlete to shoot a basketball accurately, where training is predicated on a predetermined throwing protocol established to inculcate habits and bodily positioning deemed favorable to the mechanics of shooting a projectile such as the basketball 4. As reflected in FIG. 8, the method may comprise a step 602 of making perceptible to the athlete an automatically generated first signal indicating when a body part of the athlete which influences accuracy of shooting is in an orientation which is in accord with a predetermined throwing protocol, and a step 604 of causing the athlete to shoot the ball when the first signal is active.

The method 600 may further comprise a step 606 of making perceptible to the athlete an automatically generated second signal indicating when the body part which influences accuracy of shooting is not in an orientation which is in accord with the predetermined shooting protocol, and a step 608 of causing the athlete to refrain from shooting the ball when the second signal is active.

The step 602 may comprise a further step 610 of generating a visible signal. The step 610 of generating a visible signal may comprise a still further step 612 of projecting a beam of light which causes a corresponding linear image to appear where the beam of light impinges upon the environment.

The step 612 may comprise a further step 614 of projecting light to form a generally cruciform image.

The step 606 may comprise a further step 616 of projecting a beam of light which causes a corresponding linear image to appear where the beam of light impinges upon the environment, wherein the first signal has a first optical characteristic and the second signal has a second, distinguishing optical characteristic.

The step 612 may comprise a further step 618 of rendering the first signal in one color, and the step 616 may comprise a further step 620 of rendering the second signal in a second, distinguishing color.

The step 618 may comprise a still further step 622 of rendering the first signal in a green color, and the step 620 may comprise a still further step 624 of rendering the second signal in a red color.

The step 612 may comprise a further step 626 of rendering the first signal as a constant transmission of light, and the step 616 may comprise a further step 628 of rendering the second signal as an interrupted transmission of light.

Of course, it is possible that aspects of color rendition may be combined with aspects of constant and interrupted transmission of light.

The method 600 may comprise a further step 630 of mounting the source of the first signal on the body of the athlete.

The step 630 may comprise a further step 632 of providing an adjustment mechanism capable of adjusting orientation of the source of the first signal on the body of the athlete, so that light is actually projected in an intended direction so that the horizontal condition may be accurately indicated.

The invention contemplates other methods of training an athlete to shoot a basketball accurately. According to one or more aspects of the invention any of the other methods may be regarded as comprising fewer than all of the steps listed as pertains to the method 600.

The method 600 or any other method according to one or more aspects of the invention may have the order of the listed steps changed in any way from the order described, where that is feasible.

Although presented in terms of basketball, the present invention may be employed in other athletic endeavors which require arm and body positioning relative to the environment to assure success of an athletic action. This particularly applies to other activities involving throwing a projectile, where accuracy and other goals may be furthered by controlling body motions and by concerns with aligning motions with environmental elements.

The invention also contemplates that digital control may be substituted for or provided complementarily to the apparatus of the invention, such as the apparatus 100 or 500. Digital components, where provided, may be remote from any body worn component, such as the apparatus 100 or 500, and communicate with distant or remote components in some suitable way, such as by radio frequency signals.

I claim:

1. An apparatus for indicating shooting arm position of a basketball player relative to a basketball facility, comprising:

a housing to be secured to an arm of a basketball player;

an optical projecting device at least partially enclosed within the housing, configured to selectively project a beam of light with a first optical characteristic and a beam of light with a second optical characteristic onto an environment of the basketball facility, wherein the light of the first optical characteristic is responsive to a first beam control signal in a first operating mode, and wherein the light of the second optical characteristic is responsive to a second beam control signal in a second operating mode;

a leveling sensor at least partially enclosed by the housing, configured to generate a level signal indicative of an orientation of the housing relative the basketball facility; and a controller at least partially enclosed within the housing, configured to generate the first beam control signal as a function of the level signal when an orientation of the housing is in a first orientation relative to the basketball facility and the second beam control signal as a function of the level signal when an orientation of the housing is in a second orientation relative to the basketball facility.

2. The apparatus according to claim 1, wherein the optical projecting device projects the beam of light in a generally cruciform pattern.

3. The apparatus according to claim 1, further comprising a body attachment element disposed to releasably attach the apparatus to a body of the basketball player.

4. The apparatus according to claim 3, further comprising an adjustable grip disposed between the housing and the body attachment element to enable adjustment of the optical projecting device to align with the body of the basketball player in a position assuring a first signal.

5. The apparatus according to claim 1, wherein the optical projecting device project lights of different colors, wherein light of a first color is projected in the first operating mode and light of a second color is projected in the second operating mode.

6. The apparatus according to claim 5, wherein one of said first and second lights is green in color and the other is red in color.

7. The apparatus according to claim 1, wherein the optical projecting device projects an interrupted light according to a first scheme of projection in the first operating mode and projects a constant light according to a second scheme of projection in the second operating mode.

8. An apparatus for indicating shooting arm position of a basketball player relative to a basketball facility, comprising:

a housing to be secured to an arm of a basketball player;

an optical projecting device at least partially enclosed within the housing, configured to project a beam of light in a generally cruciform pattern onto an environment of the basketball facility, wherein the beam of light is visible to the basketball player's perception when impinging upon the environment, and wherein the generally cruciform pattern indicates the vertical and horizontal shooting arm position of the basketball player relative to the basketball facility; and a body attachment element disposed to releasably attach the housing to the body of the basket player.

9. The apparatus according to claim 8, further comprising an adjustable grip disposed between the housing and a body attachment element to enable adjustment of the optical projecting device to align with the body of the basketball player in a position assuring proper shooting arm position.

* * * * *